US010859342B2

(12) United States Patent
Ludlow

(10) Patent No.: US 10,859,342 B2
(45) Date of Patent: Dec. 8, 2020

(54) FIREARM STOCK WITH BARREL-CENTERING FEATURE

(71) Applicant: H-S Precision, Inc., Rapid City, SD (US)

(72) Inventor: Christopher Ludlow, Rapid City, SD (US)

(73) Assignee: H-S PRECISION, INC., Rapid City, SD (US)

( * ) Notice: Subject to any disclaimer, the term of this patent is extended or adjusted under 35 U.S.C. 154(b) by 0 days.

(21) Appl. No.: 15/143,052

(22) Filed: Apr. 29, 2016

(65) Prior Publication Data

US 2017/0314890 A1 Nov. 2, 2017

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01); *F41A 21/485* (2013.01)

(58) Field of Classification Search
CPC ..... F41C 23/00; F41C 23/16; F41C 23/20
USPC ..... 42/71.01, 75.01, 75.03
See application file for complete search history.

(56) References Cited

U.S. PATENT DOCUMENTS 2,155,498 A * 4/1939 Laudensack ..... F41A 21/487 24/2.5
2,479,594 A * 8/1949 Yasho ..... F41A 21/485 42/75.01
2,717,465 A * 9/1955 Clark, Jr. ..... F41C 23/00 42/75.01
2,967,368 A * 1/1961 Williams ..... F41A 21/482 42/75.01
3,206,885 A * 9/1965 Garnett ..... F41C 23/00 42/75.03
3,830,003 A * 8/1974 Clerke ..... F41C 23/00 42/71.01
4,312,146 A * 1/1982 Koon, Jr. ..... F41C 23/00 42/75.03
4,385,464 A * 5/1983 Casull ..... F41C 23/00 42/75.03
4,601,124 A * 7/1986 Brown, Jr. ..... F41C 23/00 42/75.03
4,674,216 A * 6/1987 Ruger ..... F41C 23/18 42/71.01

(Continued)

*Primary Examiner* — Stephen Johnson
*Assistant Examiner* — Benjamin S Gomberg
(74) *Attorney, Agent, or Firm* — Bennet K. Langlotz; Langlotz Patent & Trademark Works, LLC

(57) ABSTRACT

A firearm stock with barrel-centering feature has an elongated body defining an elongated receiver channel and an elongated barrel channel, the receiver channel defined in part by a flat floor surface facing in upward direction, the receiver channel defined in part by opposed sidewalls extending above the floor surface, a fastener facility at the rear of the receiver channel operable to connect to the tang of the receiver, and a lateral adjustment facility forward of the fastener facility and operable to secure the receiver in a selected lateral angle of pivot about the fastener facility, such that the barrel is centerable within the barrel channel to avoid the barrel touching the stock. The lateral adjustment facility may include a set screw having an axis parallel to the floor surface of the stock. A pair of set screws opposing each other may secure the action in a selected lateral position.

9 Claims, 6 Drawing Sheets

(56) References Cited

U.S. PATENT DOCUMENTS

| | | | | |
|---|---|---|---|---|
| 5,410,834 | A * | 5/1995 | Benton | F41A 21/482 42/75.02 |
| 6,487,805 | B1 * | 12/2002 | Reynolds | F41A 21/485 42/75.03 |
| 6,637,142 | B1 * | 10/2003 | Reynolds | F41A 21/485 42/1.06 |
| 7,726,060 | B1 * | 6/2010 | Jones | F41A 3/66 42/75.02 |
| 7,841,119 | B1 * | 11/2010 | Boyd | F41C 23/20 42/71.01 |
| 8,079,169 | B2 * | 12/2011 | Gregg | F41A 3/66 42/71.01 |
| 8,230,633 | B1 * | 7/2012 | Sisk | F41C 23/06 42/75.01 |
| 8,397,417 | B2 * | 3/2013 | Jamison | F41A 21/485 42/75.03 |
| 9,285,178 | B2 * | 3/2016 | Sellars | F41A 21/485 |
| 9,341,436 | B2 * | 5/2016 | Frankel | F41C 23/00 |
| 9,726,444 | B1 * | 8/2017 | Sisk | F41A 3/66 |
| 2011/0185618 | A1 * | 8/2011 | Jamison | F41A 21/00 42/75.03 |

* cited by examiner

FIREARM STOCK WITH BARREL-CENTERING FEATURE

FIELD OF THE INVENTION

The present invention relates to firearms, and more particularly to a firearm stock with barrel-centering feature that enables the stock to accommodate any lateral deviation of the barrel relative to the receiver or the forend of the stock to the rest of the stock.

BACKGROUND OF THE INVENTION

A firearm stock is the portion of a rifle or other firearm that is held against the user's shoulder when discharging the firearm. The stock receives the barrel and the firing mechanism/action. The stock enables the user to firmly support the firearm and aim it accurately. The stock also conveys recoil to the user's body.

In order to maximize the accuracy of a firearm, the barrel and the action must be precisely fitted to the stock. A firearm having a barreled action includes a barrel portion and a receiver portion. It is very desirable for the barrel to be free floated from the stock (having a gap on all sides) to increase the firearm's accuracy. It is also very desirable for the stock to contact the receiver continuously to avoid stress points and flexibility.

A conventional high-performance stock is designed to locate off of the receiver portion of the barreled action and have no contact along any portion of the barrel to ensure the best performance. However, because of variability in the barreled action manufacturing process, the barrel is not necessarily precisely square to the front of the receiver. As a result, the barrel can veer off and create a noticeable asymmetrical gap between the barrel and the barrel channel of the stock. A sufficient lateral deviation may result in the barrel contacting the stock instead of floating freely, thereby adversely affecting accuracy and/or conveying the appearance of a poor-fitting, low-quality stock even if the firearm's accuracy is not adversely affected.

Therefore, a need exists for a new and improved firearm stock with barrel-centering feature that enables the stock to accommodate any lateral deviation of the barrel relative to the receiver or the forend of the stock to the rest of the stock. In this regard, the various embodiments of the present invention substantially fulfill at least some of these needs. In this respect, the firearm stock with barrel-centering feature according to the present invention substantially departs from the conventional concepts and designs of the prior art, and in doing so provides an apparatus primarily developed for the purpose of enabling the stock to accommodate any lateral deviation of the barrel relative to the receiver or the forend of the stock to the rest of the stock.

SUMMARY OF THE INVENTION

The present invention provides an improved firearm stock with barrel-centering feature, and overcomes the above-mentioned disadvantages and drawbacks of the prior art. As such, the general purpose of the present invention, which will be described subsequently in greater detail, is to provide an improved firearm stock with barrel-centering feature that has all the advantages mentioned above.

To attain this, the preferred embodiment of the present invention essentially comprises an elongated body defining an elongated receiver channel and an elongated barrel channel, the receiver channel defined in part by a flat floor surface facing in upward direction, the receiver channel defined in part by opposed sidewalls extending above the floor surface, a fastener facility at the rear of the receiver channel operable to connect to the tang of the receiver, and a lateral adjustment facility forward of the fastener facility and operable to secure the receiver in a selected lateral angle of pivot about the fastener facility, such that the barrel is centerable within the barrel channel to avoid the barrel touching the stock. The lateral adjustment facility may include a set screw having an axis parallel to the floor surface of the stock. A pair of set screws opposing each other may secure the action in a selected lateral position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
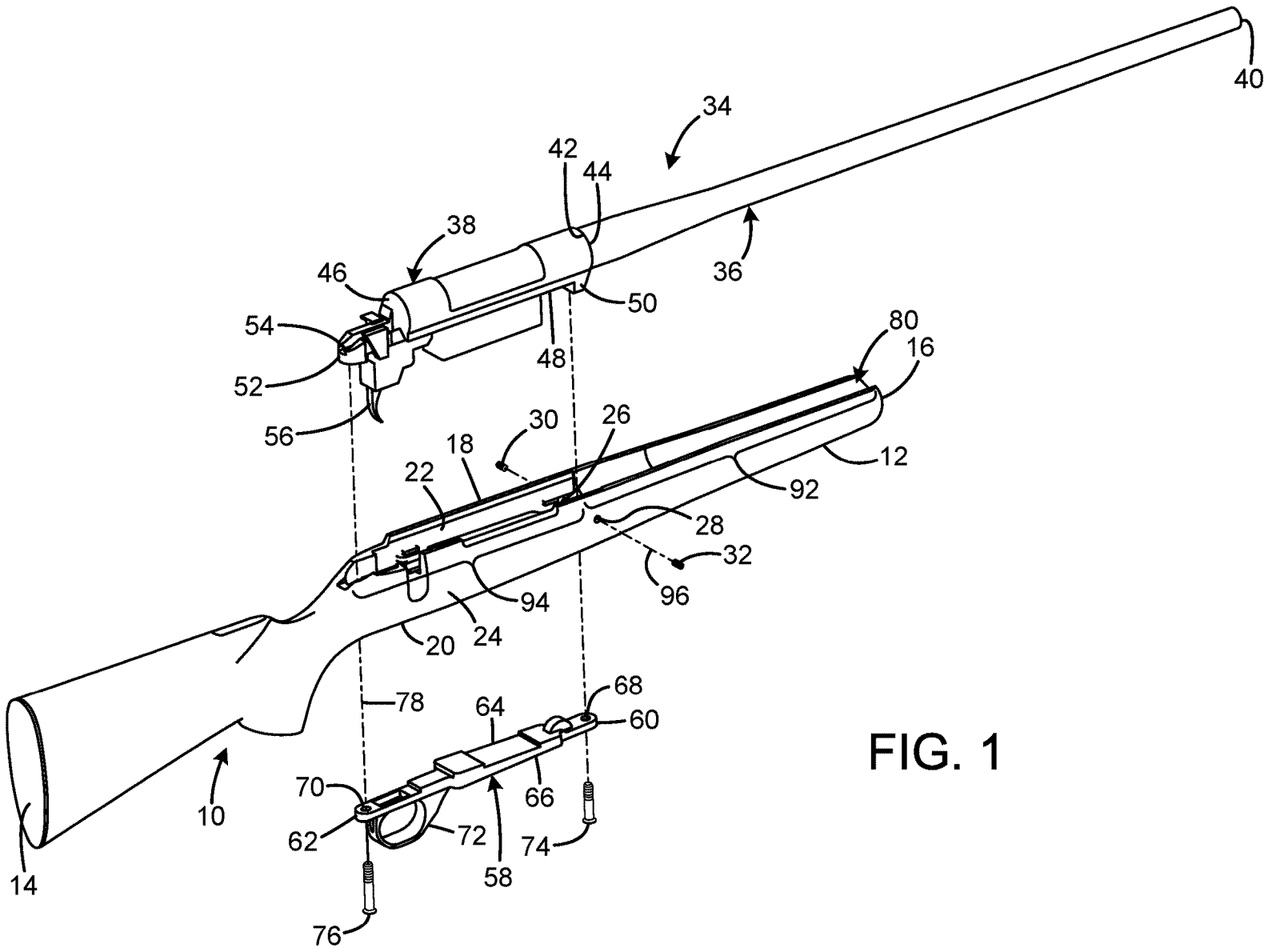
FIG. 1 is an exploded isometric view of the current embodiment of the firearm stock with barrel-centering feature constructed in accordance with the principles of the present invention.
Figure 2:
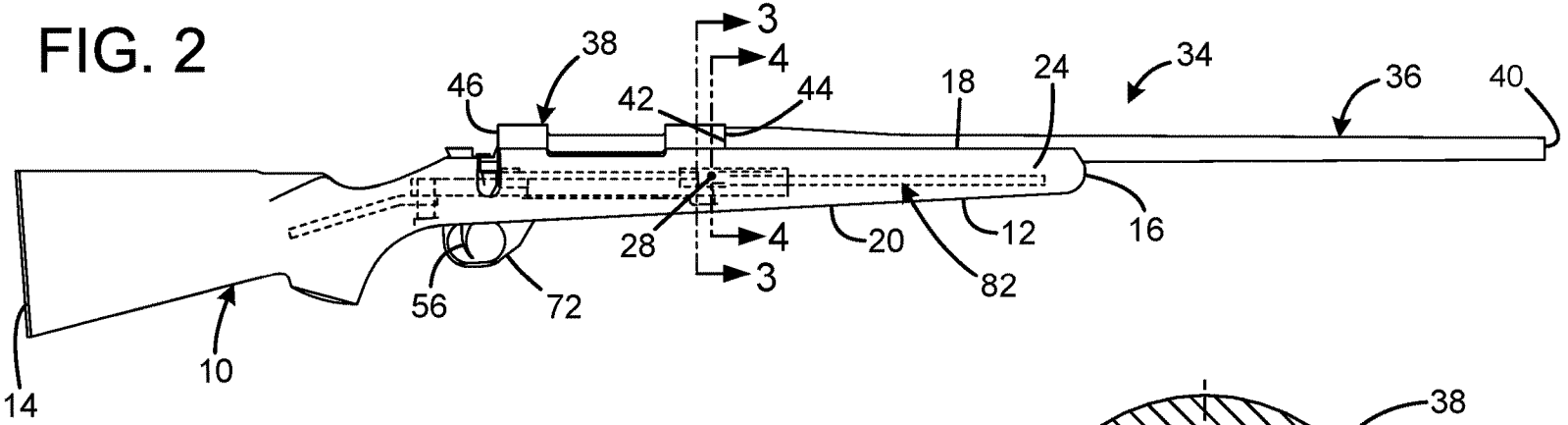
FIG. 2 is a right side view of the current embodiment of the firearm stock with barrel-centering feature of FIG. 1.
Figure 3:
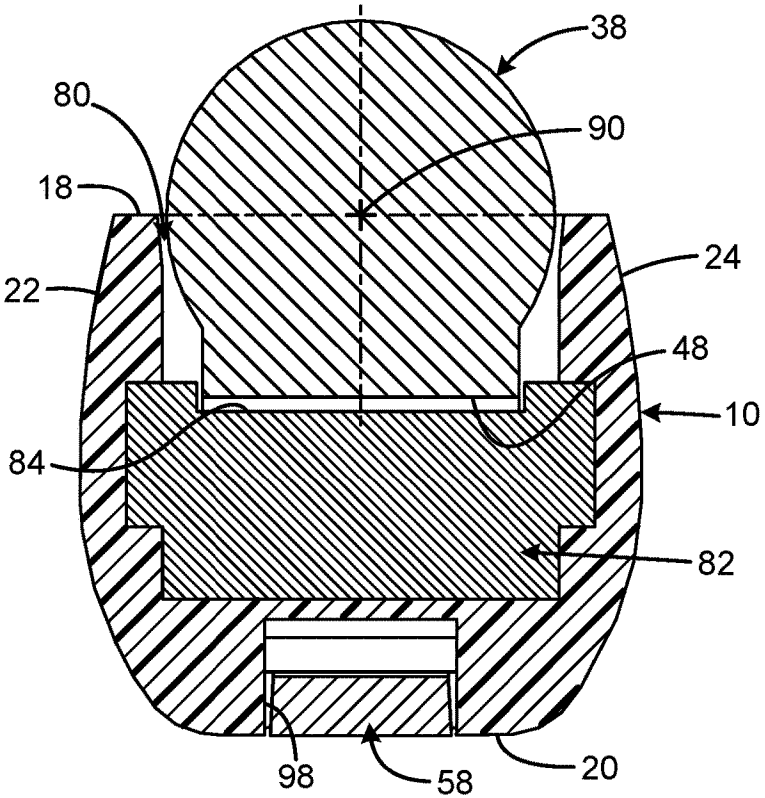
FIG. 3 is a sectional view of the current embodiment of the firearm stock with barrel-centering feature taken along line 3-3 of FIG. 2.
Figure 4:
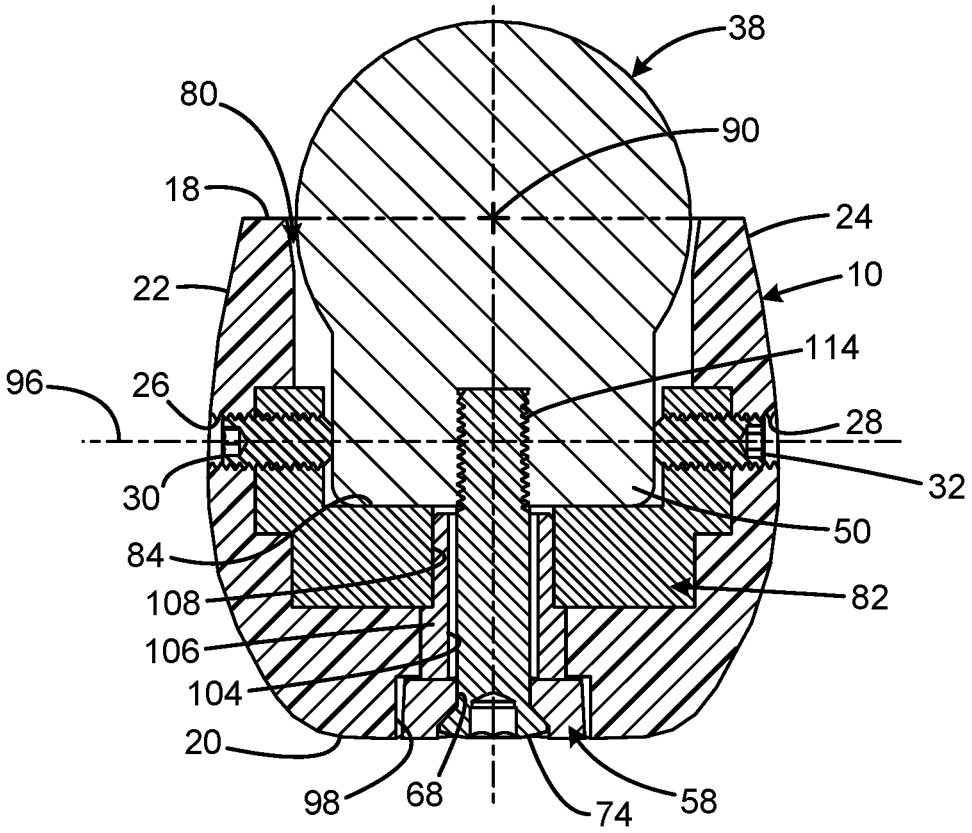
FIG. 4 is a sectional view of the firearm stock with barrel-centering feature taken along line 4-4 of FIG. 2.
Figure 5:
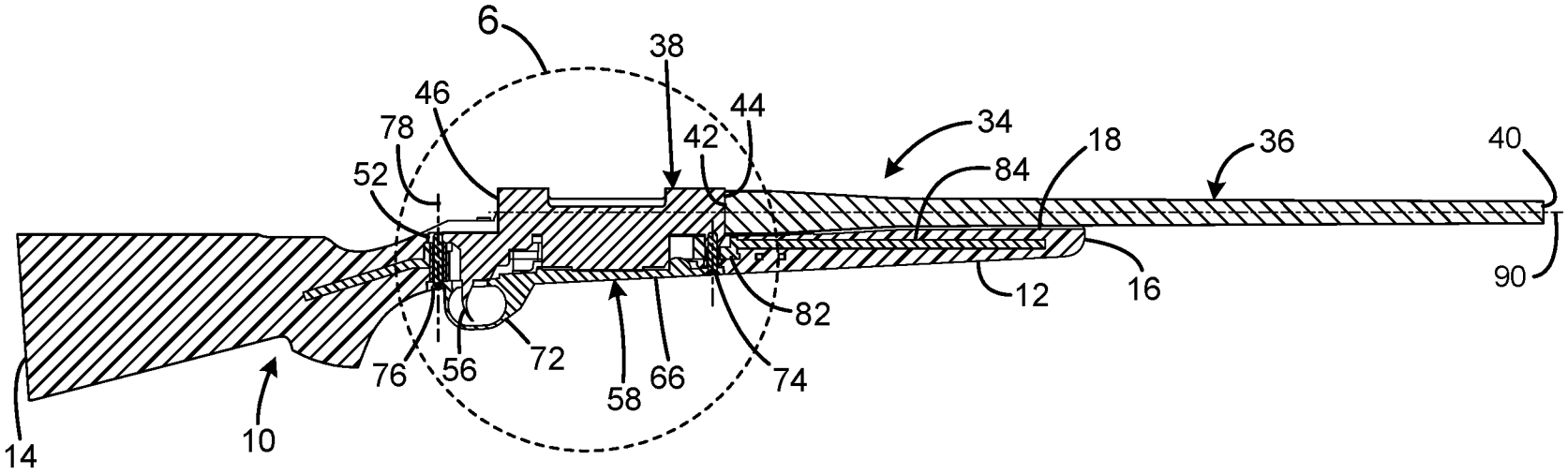
FIG. 5 is a right side sectional view of the firearm stock with barrel-centering feature of FIG. 1.
Figure 6:
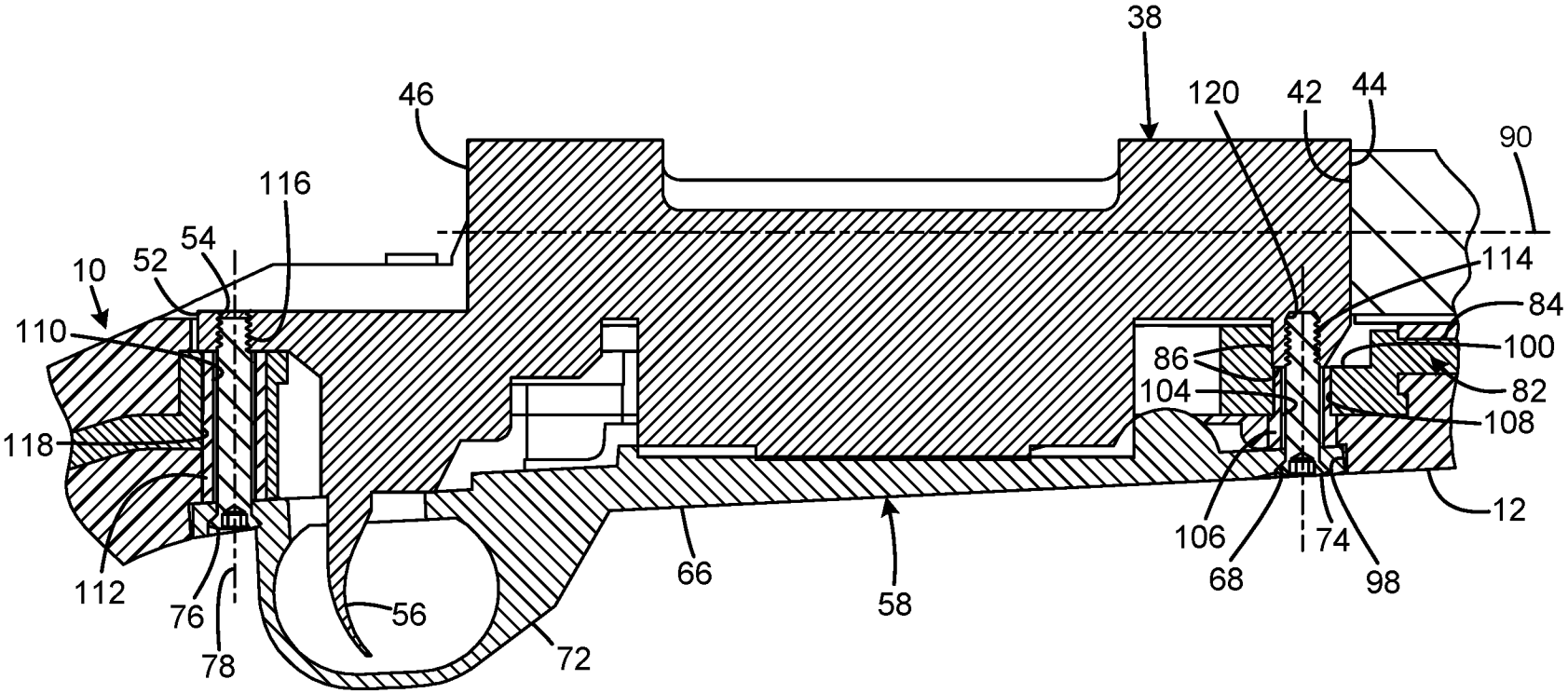
FIG. 6 is an enlarged view of the firearm stock with barrel-centering feature taken along circle 6 of FIG. 5.

An embodiment of the firearm stock with barrel-centering feature of the present invention is shown and generally designated by the reference numeral 10.

FIGS. 1-7 illustrate the improved firearm stock with barrel-centering feature 10 of the present invention. More particularly, the stock has a forend 12, butt 14, front 16, top 18, bottom 20, left side 22, and a right side 24. The left side defines a left threaded aperture 26 that receives a left set screw 30, and the right side defines a right threaded aperture 28 that receives a right set screw 32. The top defines an elongated channel 80 with a forward barrel channel portion 92 and a rearward receiver channel portion 94. The bottom defines an elongated floorplate channel 98. In the current embodiment, the left and right set screws are 10-32 flat point set screws.

A barreled action 34 is received within the channel 80. The barreled action includes a forward barrel portion 36 and a rearward receiver portion 38, which are received within the barrel channel 92 and receiver channel 94, respectively. The barrel portion has a front 40 that extends beyond the forend 12 of the stock 10 and a rear 42. The receiver portion has a front 44 that is attached to the rear of the barrel, a rear 46 that includes a rearwardly extending tang 52, and a flat bottom 48. A barrel recoil lug 50 extends downwardly below the front of the receiver, and a trigger 56 extends downwardly below the rear of the receiver. The barrel recoil lug defines an aperture 120 that receives a front action screw 74 that serves as a fastener facility when the stock 10 is assembled into a firearm. The tang defines an aperture 54 that receives a rear action screw 76 that serves as a fastener facility when the stock is assembled into a firearm.

The receiver channel 94 is defined in part by a bedding block 82 having a top 84 that serves as a flat floor surface facing in an upward direction. The left and right set screws 30, 32 define a set screw axis 96 that is parallel to the floor surface in the current embodiment. The bedding block includes a barrel lug receptacle 100 sized to receive the recoil lug 50. The receiver channel is also defined in part by the left and right sides 22, 24 of the stock 10 that are opposed sidewalls extending above the floor surface. The barrel channel 92 and receiver channel are sized such that the barrel 36 and the receiver 38 (except for the tang 52) have clearance with respect to the left and right sides of the stock. The tang is closely received within its portion of the receiver channel, such that a rear screw axis 78 defined by the rear screw 76 serves as a pivot point. The front contact surface between the bedding block and the receiver is identified by 86, where the rear of the barrel lug contacts the rear of the barrel lug receptacle. The bottom of the barrel lug also contacts the bottom of the barrel lug receptacle. In the current embodiment, the bedding block is made of aluminum.

A floorplate 58 is received within the floorplate channel 98. The floorplate has a front 60, rear 62, top 64, and bottom 66. The front of the floorplate defines a front aperture 68, and the rear of the four plate defines a rear aperture 70. A trigger guard 72 extends downward from the rear of the floorplate and encircles the trigger 56 when the stock 10 is assembled into a firearm. The front action screw 74 and the rear action screw 76 are initially inserted through the front and rear apertures in the floorplate to attach the floorplate to the stock. The front action screw and rear action screw are received within aperture 104 of front reinforcement sleeve 106 and aperture 110 of rear reinforcement sleeve 112, and are threadedly received by threads 114 within aperture 120 of the barrel recoil lug 50 and threads 116 within aperture 54 of the tang 52 when the stock 10 is assembled into a firearm. The bedding block 82 defines an aperture 108 that receives a portion of the front reinforcement sleeve, and an aperture 118 that receives a portion of the rear reinforcement sleeve.

The stock is installed on a barreled action in the following manner. First, before beginning installation of the stock, the barreled action must be checked to make sure it is not loaded, and the bolt assembly must be removed. Second, the left and right set screws are removed from both sides of the stock using a 3/32" Allen wrench. The left and right set screws are a pair of set screws opposing each other that serve as a lateral adjustment facility forward of the fastener facility operable to secure the receiver in a selected lateral angle of pivot about the fastener facility, such that the barrel is central bore within the barrel channel to avoid the barrel touching the stock.

The barreled action, magazine sleeve and trigger guard are then assembled into the stock, and the front and rear action screws are loosely installed. Subsequently, the barrel is pushed towards the right into the position indicated by dashed line 102 in FIG. 7 so the barrel touches the stock. The front and rear action screws are then finger tightened to hold the barrel in place, while still permitting the barreled action to pivot about the rear action screw. Subsequently, an adequate amount of Blue Loctite® #243 manufactured by Henkel Corporation of Rocky Hill, Conn. is applied to the first five to seven threads of the right set screw. A permanent setting thread locker must not be used.

Figure 7:
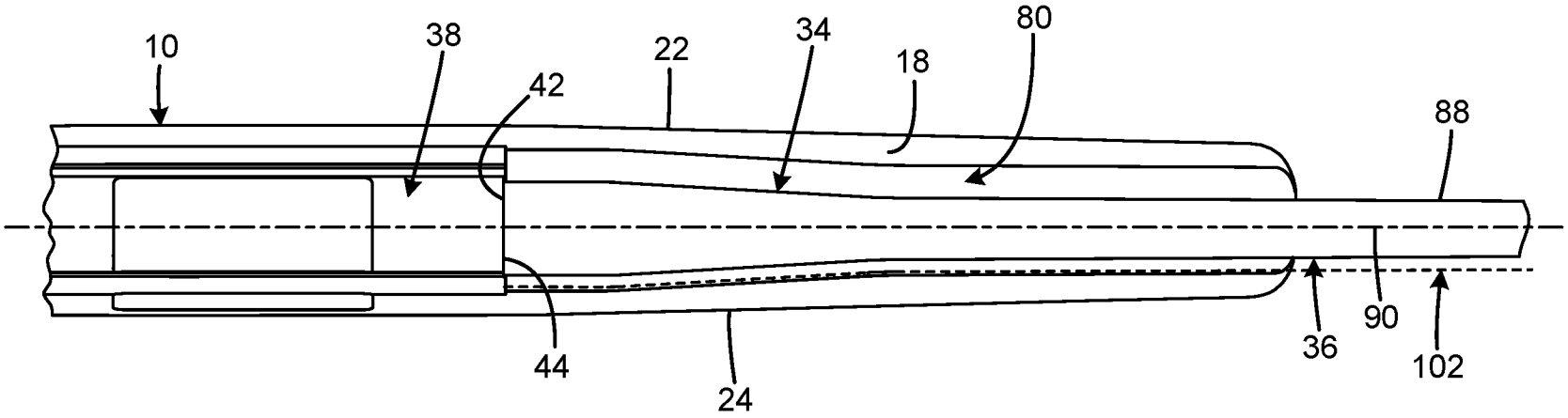
FIG. 7 is a top fragmentary view of the firearm stock with barrel-centering feature of FIG. 1.

The right set screw is then installed in the right threaded aperture. The right set screw is slowly turned inward and pushes on the receiver until the barrel axis 90 becomes centered in the stock as shown in FIG. 7. It helps to have a good light source pointing directly at the barrel channel to prevent any shadowing. Blue Loctite® #243 is then applied to the left set screw, which is installed in the left threaded aperture 26. The left set screw is turned inward until the left set screw stops against the receiver. The left set screw must not be over tightened. Small adjustments to both set screws may then be necessary for fine tuning the position of the barrel axis within the channel. Once a satisfactory barrel position is achieved, the front and rear action screws are then tightened to 65 inch pounds. Loctite® begins to harden in 5 minutes and fully cures in 24 hours. The Loctite® must be allowed to cure before the firearm is discharged.

An optional epoxy bedding step may then be performed to further enhance the accuracy of the firearm. In order to remove the barreled action while retaining the barrel centering adjustment, only the left set screw should be backed out by ¼ of a turn. The subsequent removal of the action screws permits removal of the barreled action from the stock without requiring any change the location of the right set screw. The magazine and floorplate are also removed. Subsequently, the aluminum bedding block is wiped clean with an acetone, denatured alcohol, or rubbing alcohol solvent using a cotton ball or cotton swab. Care must be taken not to splash the solvent onto the stock finish. A thin coat of release agent, such as SC Johnson® Paste Wax manufactured by S. C. Johnson & Son, Inc. of Racine, Wis., is then applied to the action, magazine sleeve, threaded screw holes, and action screws. An epoxy resin/hardener pack is then opened, and the putty inside is pressed and kneaded in the palm of the user's hands until all streaks in the putty have disappeared. The putty is then rolled into a fine rope about 3/16" diameter and divided into two 1" long "rope" pieces. Each putty rope is then placed on the sides of the bedding block and folded over the front edge of the bedding block. This procedure must be completed quickly because the putty working time is only two to three minutes. In the current embodiment, the putty is Oatey® Fix-It™ Stick Epoxy Putty manufactured by Oatey, Inc. of Cleveland, Ohio.

To then reassemble the firearm, the barreled action is reinstalled in the stock, and the action screws are finger tightened. The left set screw is then tightened the same amount as in the initial installation to center the barrel in the stock against the right set screw. The front and rear action screws are then tightened to 65 inch pounds. Any excess epoxy that oozes out from around the stock is cutaway, and the firearm is cured in a horizontal position for 24 hours before shooting.

While a current embodiment of a firearm stock with barrel-centering feature has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the contact surfaces and gaps between the bedding block and the barreled action may vary depending upon the brand of barreled action used with the stock of the current invention. Furthermore, the front action screw may be positioned behind the recoil lug rather than penetrating the recoil lug as shown when used with other types of barreled actions.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stock for a barreled rifle action having a barrel, an essentially flat bottom, left and right sides, and a rear tang, the stock comprising:

an elongated body defining an elongated action channel and an elongated barrel channel;

the body including a bedding block;

the action channel defined in part by an essentially flat floor surface of the bedding block facing in an upward direction;

the action channel defined in part by opposed parallel sidewalls of the bedding block extending above the floor surface;

a rear fastener at a rear of the action channel operable to connect to the tang of the action;

a forward fastener at a forward portion of the action channel operable to connect to a forward portion of the action;

the floor surface of the bedding block defining a forward fastener aperture having an opening at the floor surface and extending perpendicularly thereto and receiving the forward fastener to provide a range of lateral positions of the forward fastener within the forward fastener aperture; and a lateral adjustor forward of the rear fastener, adapted to contact the action, and operable to secure the action in a selected lateral angle of pivot about the rear fastener, such that the barrel is centerable within the barrel channel to avoid the barrel touching the stock.

2. The stock of claim 1 wherein the lateral adjustor includes a set screw having an axis essentially parallel to the floor surface of the bedding block.

3. The stock of claim 1 wherein the lateral adjustor comprises a pair of set screws opposing each other to secure the action in the selected lateral angle.

4. The stock of claim 1 wherein the stock defines a barrel lug receptacle forward of the floor surface and adapted to receive a barrel lug of the barreled action.

5. The stock of claim 4 wherein a rear portion of the barrel lug contacts a rear side of the barrel lug receptacle.

6. The stock of claim 4 wherein a bottom portion of the barrel lug contacts a bottom portion of the barrel lug receptacle.

7. The stock of claim 4 including a second fastener at the forward portion of the action channel operable to connect to the forward portion of the action.

8. The stock of claim 7 wherein the second fastener is operable to connect to the barrel lug of the action.

9. The stock of claim 1 wherein the barrel channel and the action channel are larger than the barrel and the action respectively, such that the barrel and the action, except for the tang, are spaced apart with respect to left and right sides of the stock.

* * * * *